US006981539B2

(12) United States Patent
Fraczek

(10) Patent No.: US 6,981,539 B2
(45) Date of Patent: Jan. 3, 2006

(54) HARDWARE AND CLUTCH MECHANISM FOR WINDOW TREATMENT

(75) Inventor: Richard Fraczek, Stamford, CT (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 10/809,314

(22) Filed: Mar. 24, 2004

(65) Prior Publication Data

US 2005/0211394 A1 Sep. 29, 2005

Related U.S. Application Data

(60) Provisional application No. 60/456,974, filed on Mar. 24, 2003.

(51) Int. Cl.
*A47H 11/06* (2006.01)

(52) U.S. Cl. ..... 160/84.05; 160/173 R; 160/321; 474/175

(58) Field of Classification Search ..... 160/84.05, 160/170, 171, 193, 321; 254/393, 391; 474/175, 474/174, 178
See application file for complete search history.

(56) References Cited

U.S. PATENT DOCUMENTS 361,573 A * 4/1887 Baville ..... 474/175
5,184,660 A * 2/1993 Jelic ..... 160/171

* cited by examiner

*Primary Examiner*—Blair M. Johnson
(74) *Attorney, Agent, or Firm*—Gottlieb, Rackman & Reisman, P.C.

(57) ABSTRACT

A window treatment support, such as a support for a cellular shade and other kinds of shades, includes a head rail, a clutch mounted on the head rail to support and operate a window treatment; and a cord engaging the clutch for selectively raising and lowering the window treatment. The clutch includes a pulley having a plurality of radial teeth defining a space sized to receive the cord. At least some of the teeth including a flexible projection forming an interference fit with the cord. The head rail is a bottom wall shaped to maximize the size of the clutch without substantially affecting the size of the head rail.

16 Claims, 4 Drawing Sheets

HARDWARE AND CLUTCH MECHANISM FOR WINDOW TREATMENT

RELATED APPLICATIONS

This Application claims priority to Provisional Application Ser. No. 60/456,974 filed Mar. 24, 2003 and incorporated herein by reference.

BACKGROUND OF THE INVENTION

1. Field of Invention

This invention pertains to a support for shades, including cellular shades and other window treatments, and more particularly, to a mechanism with an improved and more effective head rail and clutch.

2. Background of the Invention

In recent years, a number of mono-control mechanisms were invented that allow lifting and lowering of cellular blinds. The early mechanisms were developed that utilized clutches and rotating lift, which required substantially more space than traditional cord, lock devices. The height and depth of these mechanisms usually exceeded 1 inch. Moreover, typically the drop length of the shade would determine the size of the spool in which lifting tape would be gathered. The longer the drop, the bigger the spool and head rail had to be. In other words, due to the complexity of the clutch mechanisms and the lift sets utilizing cords and tapes, larger head rails had to be developed to provide proper enclosure for these mechanisms. The size, and more particularly weight of the fabric of the shade were the major factors for the requirement of big clutch mechanisms. However, oversized head rail enclosures were objectionable because they detracted from the esthetical appearance of the shade.

Another disadvantage of the early mechanisms pertained to the structure of the pulley in the clutch. Typically the perimeter of the pulley was designed with series of rigid ramps with sharp edges forming a serpentine path receiving and engaging a cord trained around the perimeter. Sharper and more aggressive edges provided a solid engagement with the cord, thereby increasing the friction between the cord and the pulley and decreasing, or even eliminating slippage. By the same token, however, these sharp edges also tended to cut and fray the cord fibers and therefore reduce the useful life of the cord.

SUMMARY OF THE INVENTION

A window treatment support for holding and operating a window treatment, such as a shade, by selectively lowering and raising said shade, said support comprising a head rail with two opposed ends and receiving the window treatment; a clutch disposed at one end; an end cap disposed at the other end; and a shaft extending between said clutch and said end cap. The member is rotatable by said clutch and is arranged to receive an activating element from the window treatment to operate said window treatment. The clutch includes a pulley disposed co-axially with said shaft, said pulley including a plurality of teeth. At least some of the teeth have flexible projections. The teeth are arranged to receive a cord for operating said clutch. The flexible projections forming an interference fit with the cord.

Preferably, the pulley includes a cylindrical wall and each tooth includes a frame dependent from said cylindrical wall with said projection being suspended from said frame. The projections can be angled axially inwardly toward the opposite teeth and can have a free end and a substantially flat contact surface adjacent to the free end.

The pulley can include a first set teeth and a second set of teeth, said first and second sets being axially spaced along the cylindrical wall. The teeth form a serpentine channel for receiving said cord.

Preferably, the head rail includes a side wall and a bottom having two lateral portions and a center portion, the lateral side and said center portion extending longitudinally, and thee center portion being further spaced from a longitudinal axis of the head rail and than said side wall.

DETAILED DESCRIPTION OF THE INVENTION

Figure 1:
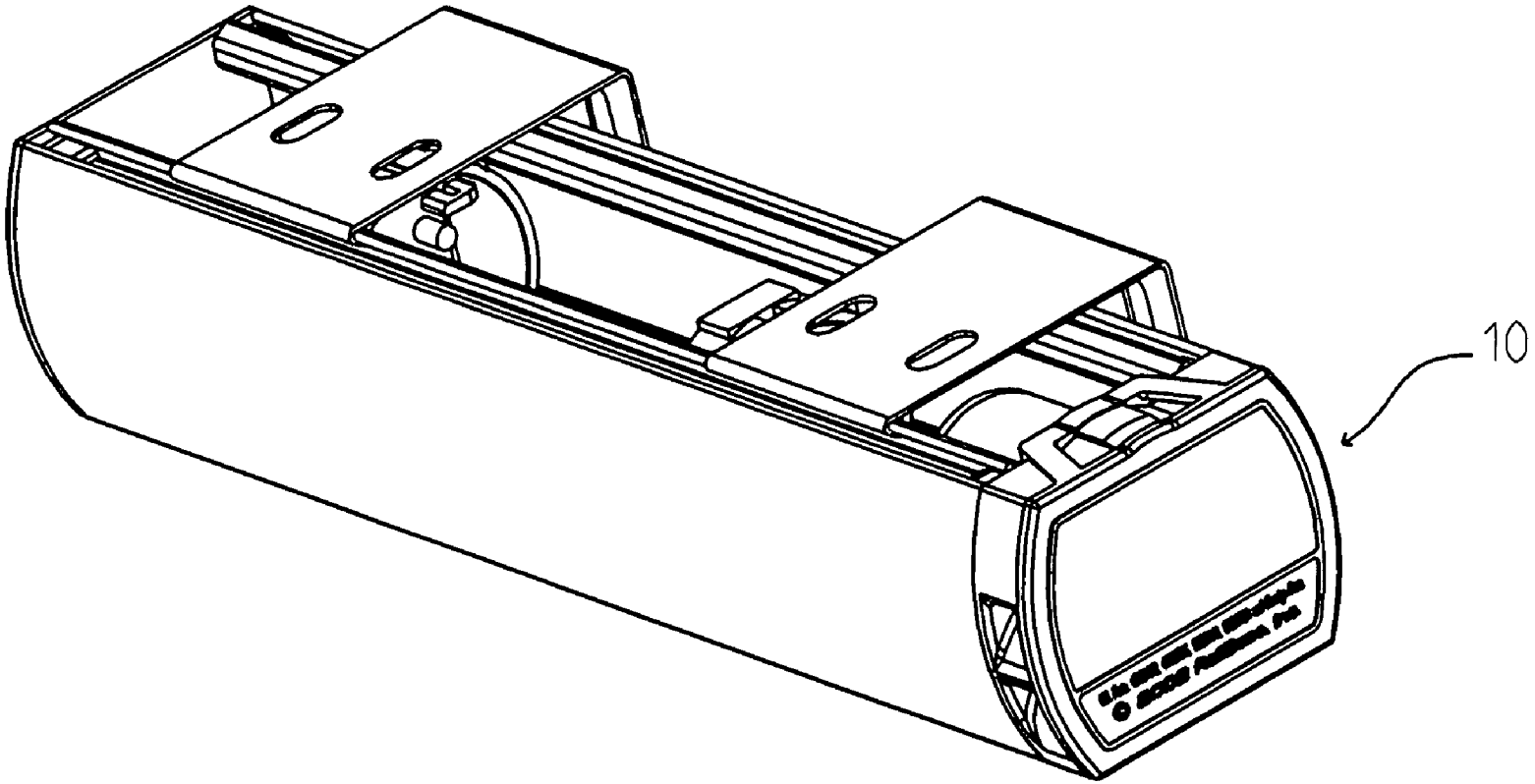
FIG. 1 shows an isometric view of a shade support mechanism in accordance with this invention.

As shown in the Figures, a shade support 10 constructed in accordance with this invention, includes a head rail 12, a clutch housing 14, an end cap 16, one or more lifts 18 and a shaft 20. The support 10 is mounted in a window opening or on a wall (not shown) by brackets 22. The brackets 22 are shaped so that they can engage either the front wall 24 or the back wall 26 of the head rail 12. Front wall 24 has a somewhat curved profile while the back wall 26 is substantially straight. Thus, a customer can be given the option of mounting the support 10 so that either the front wall 24, or the back wall 26 are facing inwardly.

Figure 4A:
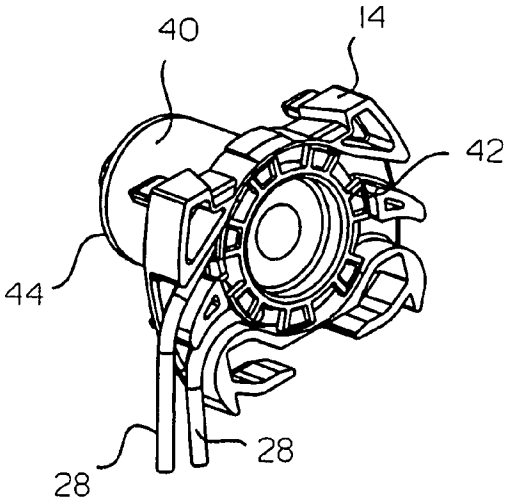
FIG. 4A shows an isometric view of the clutch and the clutch housing used in the shade support mechanism of FIGS. 1 and 2A.
Figure 4B:
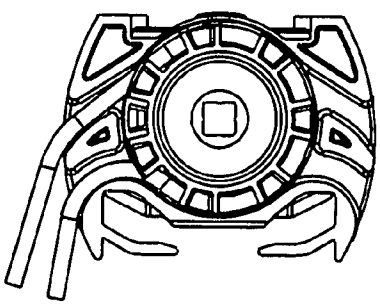
FIG. 4B shows an end view of the clutch mechanism and housing of FIG. 4A.
Figure 3A:
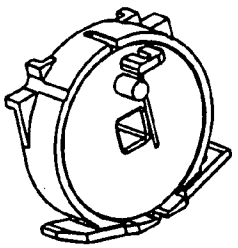
FIG. 3A shows an isometric view of a lift in the mechanism of FIGS. 1 and 2.
Figure 3B:
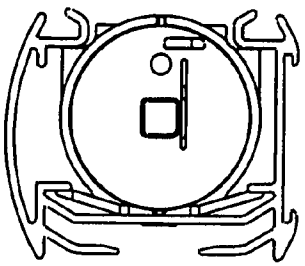
FIG. 3B shows a side view of the support mechanism with the lift shown in FIG. 3A in place.

The shaft 20 extends longitudinally through the head rail 12 and is supported by the clutch (discussed in more detail below) and the lifts 18. A typical shade (not shown) has blades or cells that are supported by strings or other similar activating members (not shown) trained about the lifts 18. A cord 28 with two ends (shown in FIGS. 4A and 4B) is trained around the clutch 15. Pulling one end of the cord 28 causes the clutch to turn (as described in more detail below) in one direction and pulling the other end of the cord 28 causes the clutch to turn in the opposite direction. The rotation of the clutch is transmitted to the lifts 18 by the shaft 20. Rotation in one direction causes the strings of the shade to wind up on the lifts 18 and to pull up or lift the shades. Rotation in the opposite direction causes the strings to wind down from the lifts 18 and allow the shades to lower.

Figure 2A:
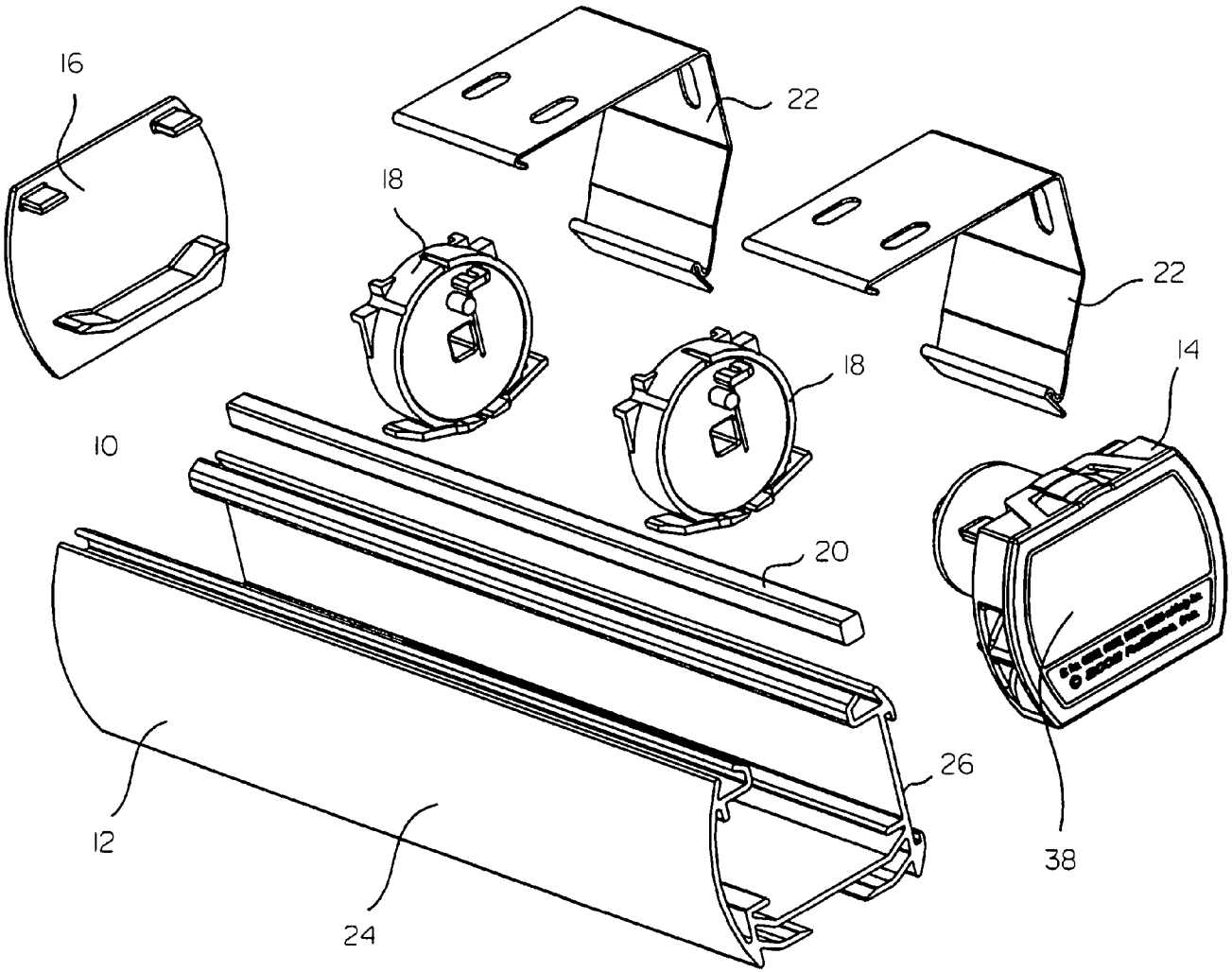
FIG. 2A shows an exploded view of the shade support mechanism of FIG. 1.
Figure 2B:
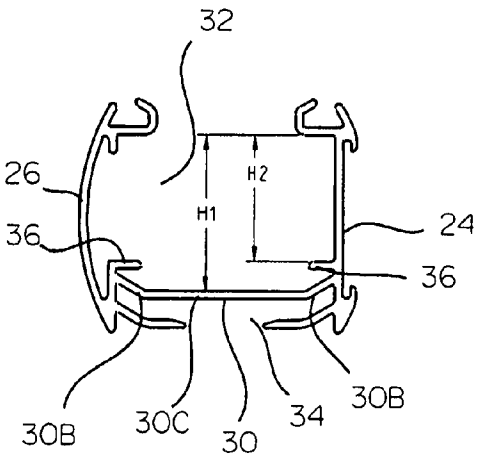
FIG. 2B shows an elevational cross-sectional view of the support mechanism head rail in FIG. 2A.

Referring now to FIGS. 2A and 2B, the head rail 12 is formed with a bottom wall 30 that extends substantially horizontally forms two trough shaped chambers: an upper chamber 32 and a lower chamber 34. The upper chamber 32 holds the clutch 15, lifts 18 and shaft 20. The lower chamber is used for mounting the upper part of the shade (not shown). This shade can be cellular shade, a venitian blind or other type of window treatment.

The bottom wall 30 has a trapezoidal shape with a central portion 30C and two lateral portions 30A and 30B angled upwards as shown. The central portion is disposed further from a longitudinal axis of the head rail 12 then the back wall 26. Above the bottom wall 30 there are two facing lips 36. These lips 36 engage and form a respective interference fit with the clutch housing 14, the end cap 16 and the lifts 18 and hold these elements in place. As discussed above, it is important to provide the shade support mechanism with a large-sized clutch so that it can provide a large mechanical advantage for the raising of the shade. The dimension that has the biggest effect on the size of the clutch is the effective height H1 of the upper chamber 32. In previous shade support mechanisms, the bottom wall was planar and it was disposed at the position of the two lips 36. Therefore the effective height of the upper chamber was much smaller, as indicated in FIG. 2B at H2. Hence the upper chamber 32 could accommodate a smaller clutch mechanism then the head rail 12 shown herein. In other words, the head rail 12 is able to accommodate a bigger clutch because of the shape and configuration of its bottom wall 30. Of course, the bottom wall 30 could have different shapes as well and still achieve the same effect. For example, the bottom wall could be curved.

In FIGS. 1 and 2A, only the clutch housing 14 is visible, with the actual clutch being hidden by a cover 38. Details of the clutch 40 are shown in FIGS. 4A, 4B, 5A and 5B. The clutch 40 includes a pulley 42 and a boss 44. The pulley 42 has a peripheral cylindrical wall 46. This wall 46 is formed with two sets of radial gripping teeth 48, 50. Teeth 48 are placed axially inwardly of teeth 50 and define therebetween a serpentine-shaped annular channel 52 having dimensions that are approximately equal to the diameter of the cord 28.

Each tooth 48, 50 is formed of two radial posts 53, 54 connected at their top by a cross piece 56. The posts 53, 54 and cross piece 56 form a frame 58. A projection 60 is suspended from the cross-piece 56 and extends radially inwardly therefrom. In addition, the projection 60 is also angled so that it extends between the teeth 48 and 50 to define at least part of the annular space 52 as shown. The projection 60 is somewhat flexible so that it can be deflected axially, i.e. toward or away from frame 58. The projection 60 also has an engaging surface 64. When the pulley 42 is introduced into the housing 14, the housing and the serpentine channel form a torroidal space for the cord 28.

As discussed above, in the prior art, pulleys for shade supports were provided with rigid ramps with sharp edges that cut into, and degraded the cord over time. In the present invention, as a cord 28 is introduced into the channel between the teeth 48, 50, it pushes the projections 60 of teeth 48, 50 axially outwardly the respective frames 58. Therefore, once the cord 28 is introduced between the teeth 48, 50, an interference fit is formed between the projections 60 and the cord 20 that provides a gripping force on the cord and insures that there is no slippage as the cord 28 is pulled one way or the other. However the flexibility of the projections 60 and the shape and positioning of the engaging surface 64 insures that the fibers of the cord are not cut and therefore the cord is not damaged.

Figure 5A:
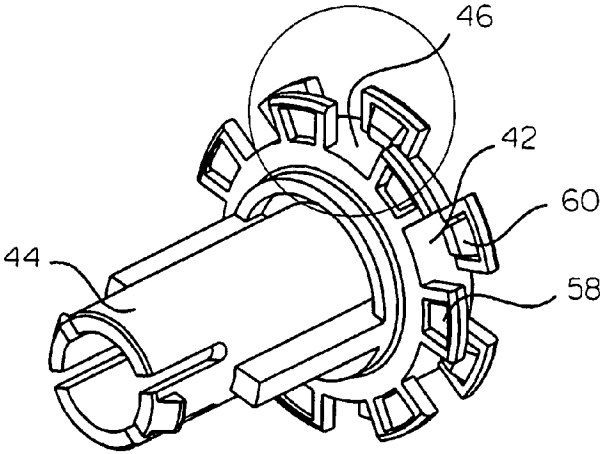
FIG. 5A shows an isometric view of the pulley of FIGS. 4A and 4B.
Figure 5B:
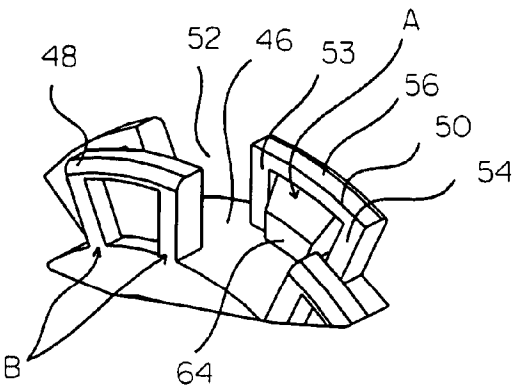
FIG. 5B shows an enlarged view of the pulley with details of the teeth used for the engagement of the cord.

As shown in the FIGS. 5A and 5B, preferably, the teeth of the set 48 are angularly offset from the teeth of set 50. so that the projection on one tooth 48 is not opposite a projection on a tooth 50. Moreover, the teeth of one set are offset from the teeth of the other set. This configuration forces the cord to take a serpentine path along channel 52.

In an alternate embodiment of the invention, only some of the teeth have the flexible projections 60. For example, all the teeth on one side may have the projection, or every second or every third tooth from both sets 48 and 50 is provided with a projection 60.

While the invention has been described with reference to several particular embodiments, it is to be understood that these embodiments are merely illustrative of the principles of the invention. Accordingly, the embodiments described in particular should be considered as exemplary, not limiting, with respect to the following claims.

I claim:

1. A window treatment support comprising:

a head rail;

a pulley disposed on said head rail to operate a window treatment; and a cord engaging said pulley for selectively raising and lowering the window treatment;

wherein said pulley having a plurality of integral radial teeth defining a space sized to receive said cord, at least some of said teeth including an integral flexible projection extending into said space, said flexible projection being arranged and constructed to flex when said cord is disposed in said channel thereby forming an interference fit with said cord, said pulley, teeth and flexible projections being molded together from the same material.

2. The support of claim 1 wherein said pulley includes a cylindrical wall and said teeth are formed integrally with said cylindrical wall.

3. The support of claim 2 wherein two sets of teeth are provided on said cylindrical wall, said sets of teeth being axially offset.

4. The support of claim 3 wherein the teeth of each set are angularly offset from each other.

5. The support of claim 1 wherein all the teeth are provided with said flexible projection.

6. A window treatment support for holding and operating a window treatment, such as a shade, by selectively lowering and raising said shade, said support comprising:

a head rail with two opposed ends and receiving the window treatment;

a pulley disposed at one end;

an end cap disposed at the other end; and a shaft disposed between said ends, said shaft being rotatable by said pulley and being arranged to receive an activating element from the window treatment to operate said window treatment;

wherein said pulley is disposed co-axially with said shaft, said pulley being formed with a cylindrical wall and a plurality of integral teeth disposed on said cylindrical wall and defining a channel receiving a cord, at least some teeth having projections, said teeth engaging said cord with said projections for operating said pulley, with said projections bending with respect to said cylindrical wall to form an interference fit with the cord, said pulley, teeth and projections being molded together from the same material.

7. The support of claim 6 wherein each tooth includes a frame dependent from said cylindrical wall with said projection being suspended from said frame.

8. The support of claim 7 wherein said projections are angled axially inwardly toward the opposite teeth.

9. The support of claim 7 wherein said projections have a free end, and a contact surface adjacent to said free end.

10. The support of claim 6 wherein said pulley includes a first set teeth and a second set of teeth, said first and second sets being axially spaced along said cylindrical wall.

11. The support of claim 10 wherein all the teeth have projections.

12. The support of claim 10 wherein the teeth of one set are angularly offset from the teeth of the other set.

13. The support of claim 12 wherein said channel has a serpentine shape.

14. The support of claim 7 wherein said projections are cantileveredly attached to the frame.

15. The support of claim 6 wherein said head rail includes two opposed side walls spaced at a first distance and a bottom having two lateral portions and a center portion, said lateral portions and said center portion extending longitudinally, said center portion being farther spaced from a longitudinal axis of the head rail than said lateral portions and having a width smaller than said first distance.

16. The support of claim 6 wherein each tooth has an opening and the respective projection moves into said opening as it bends to accept the cord.

* * * * *